US011823860B1

(12) United States Patent
Ando

(10) Patent No.: US 11,823,860 B1
(45) Date of Patent: Nov. 21, 2023

(54) X-RAY GENERATING APPARATUS, METHOD OF ADJUSTING TARGET, AND METHOD OF USING X-RAY GENERATING APPARATUS

(71) Applicant: CANON ANELVA CORPORATION, Kawasaki (JP)

(72) Inventor: Yoichi Ando, Tokyo (JP)

(73) Assignee: CANON ANELVA CORPORATION, Kawasaki (JP)

( * ) Notice: Subject to any disclaimer, the term of this patent is extended or adjusted under 35 U.S.C. 154(b) by 0 days.

(21) Appl. No.: 18/350,953

(22) Filed: Jul. 12, 2023

Related U.S. Application Data

(63) Continuation of application No. PCT/JP2022/016711, filed on Mar. 31, 2022.

(51) Int. Cl.
*H01J 35/00* (2006.01)
*H01J 35/08* (2006.01)
*H01J 35/14* (2006.01)

(52) U.S. Cl.
CPC ..... *H01J 35/08* (2013.01); *H01J 35/153* (2019.05); *H01J 2235/085* (2013.01)

(58) Field of Classification Search
CPC ..... H01J 35/08; H01J 35/153; H01J 2235/085
See application file for complete search history.

(56) References Cited

U.S. PATENT DOCUMENTS 7,983,394 B2 * 7/2011 Kozaczek ..... H01J 35/112 378/138
2011/0150184 A1 6/2011 Kozaczek et al.
2020/0353288 A1 11/2020 Shaw et al.

FOREIGN PATENT DOCUMENTS

JP H06124671 A 5/1994
JP 2001126650 A 5/2001
WO 2020084664 A1 4/2020

OTHER PUBLICATIONS

International Search Report (PCT/ISA/210) with translation and Written Opinion (PCT/ISA/237) dated Jun. 21, 2022, by the Japan Patent Office as the International Searching Authority for International Application No. PCT/JP2022/016711. (16 pages).

* cited by examiner

*Primary Examiner* — Dani Fox
(74) *Attorney, Agent, or Firm* — BUCHANAN INGERSOLL & ROONEY PC

(57) ABSTRACT

An X-ray generating apparatus includes an electron gun, a target configured to generate X-rays by being irradiated with an electron beam emitted from the electron gun, and a controller configured to control a first mode for thinning the target by irradiating the target with an electron beam with a current adjusted within a first current range and a second mode for generating X-rays by irradiating the target with an electron beam with a current adjusted within a second current range. The first current range has a lower limit larger than an upper limit of the second current range.

15 Claims, 9 Drawing Sheets

X-RAY GENERATING APPARATUS, METHOD OF ADJUSTING TARGET, AND METHOD OF USING X-RAY GENERATING APPARATUS

CROSS-REFERENCE TO RELATED APPLICATIONS

This application is a Continuation of International Patent Application No. PCT/JP2022/016711 filed Mar. 31, 2022, which is hereby incorporated by reference herein in its entirety.

BACKGROUND OF THE INVENTION

Field of the Invention

The present invention relates to an X-ray generating apparatus, a method of adjusting a target, and a method of using the x-ray generating apparatus.

Background Art

In a transmission type X-ray tube, a target is irradiated with an electron beam to emit X-rays from the target. The electron beam generated at the cathode is accelerated by an accelerating voltage and irradiates the target. Changing this accelerating voltage will change the energy of an electron beam colliding with the target. If the target is thinner than the optimal thickness, part of an electron beam is transmitted through the target, and hence the dose of X-rays generated decreases. In contrast to this, if the target is thicker than the optimal thickness, generated X-rays are attenuated when transmitted through the target. That is, the thickness of a target which maximizes the dose of X-rays changes depending on the accelerating voltage. Accordingly, a single target imposes limitation on the range of accelerating voltages. In order to expand the range of accelerating voltages, it is necessary to prepare a plurality of targets having thicknesses different from each other.

Japanese Patent Laid-Open No. 2001-126650 discloses a transmission type X-ray tube apparatus including an X-ray transmission window, a thin metal film that forms an X-ray target provided on the vacuum side of the X-ray transmission window, an electron gun that generates an electron beam, and a deflector that deflects the electron beam. This thin metal film has a gradually changing thickness. In this X-ray tube apparatus, an electron beam irradiates a place where the thickness of the thin metal film coincides with the depth that an electron enters. However, since X-ray tube apparatuses have individual differences due to the processing accuracies of thin metal films, the assembly tolerances of the X-ray tube apparatuses, and the like, it is difficult to cause an electron beam to accurately enter a target position on a thin metal film, that is, a position where the film has a target film thickness. Accordingly, a conventional X-ray tube apparatus requires a special configuration or adjustment step for adjusting the incident position of an electron beam with respect to a thin metal film.

SUMMARY OF INVENTION

The present invention provides a technique advantageous in efficiently generating X-rays.

A first aspect of the present invention relates to an X-ray generating apparatus including an electron gun and a target configured to generate X-rays by being irradiated with an electron beam emitted from the electron gun. The X-ray generating apparatus includes a controller configured to control a first mode for thinning the target by irradiating the target with an electron beam with a current adjusted within a first current range and a second mode for generating X-rays by irradiating the target with an electron beam with a current adjusted within a second current range. The first current range has a lower limit larger than the upper limit of the second current range.

A second aspect of the present invention relates to an adjustment method of adjusting a thickness of a target in an X-ray generating apparatus including an electron gun and the target configured to generate X-rays by being irradiated with an electron beam emitted from the electron gun. The adjustment method includes a thinning step of thinning the target by irradiating the target with an electron beam with a current adjusted within a first current range and a detecting step of detecting X-rays generated by irradiating the target with an electron beam with a current adjusted within a second current range. The first current range has a lower limit larger than an upper limit of the second current range.

A third aspect of the present invention relates to a method of using an X-ray generating apparatus including an electron gun and a target configured to generate X-rays by being irradiated with an electron beam emitted from the electron gun. The method includes a thinning step of thinning the target by irradiating the target with an electron beam with a current adjusted within a first current range and a generating step of generating X-rays by irradiating the target with an electron beam with a current adjusted within a second current range. The first current range has a lower limit larger than an upper limit of the second current range.

The disclosure includes an X-ray generating apparatus including an electron gun, a target configured to generate X-rays by being irradiated with an electron beam emitted from the electron gun, and a deflector configured to deflect the electron beam. In the X-ray generating apparatus, the target has a plurality of concave portions, the plurality of concave portions are arranged at positions respectively corresponding to a plurality of accelerating voltages to be applied between a cathode of the electron gun and the target, and the target has thicknesses different from each other at the plurality of concave portions.

DESCRIPTION OF EMBODIMENTS

Figure 1:
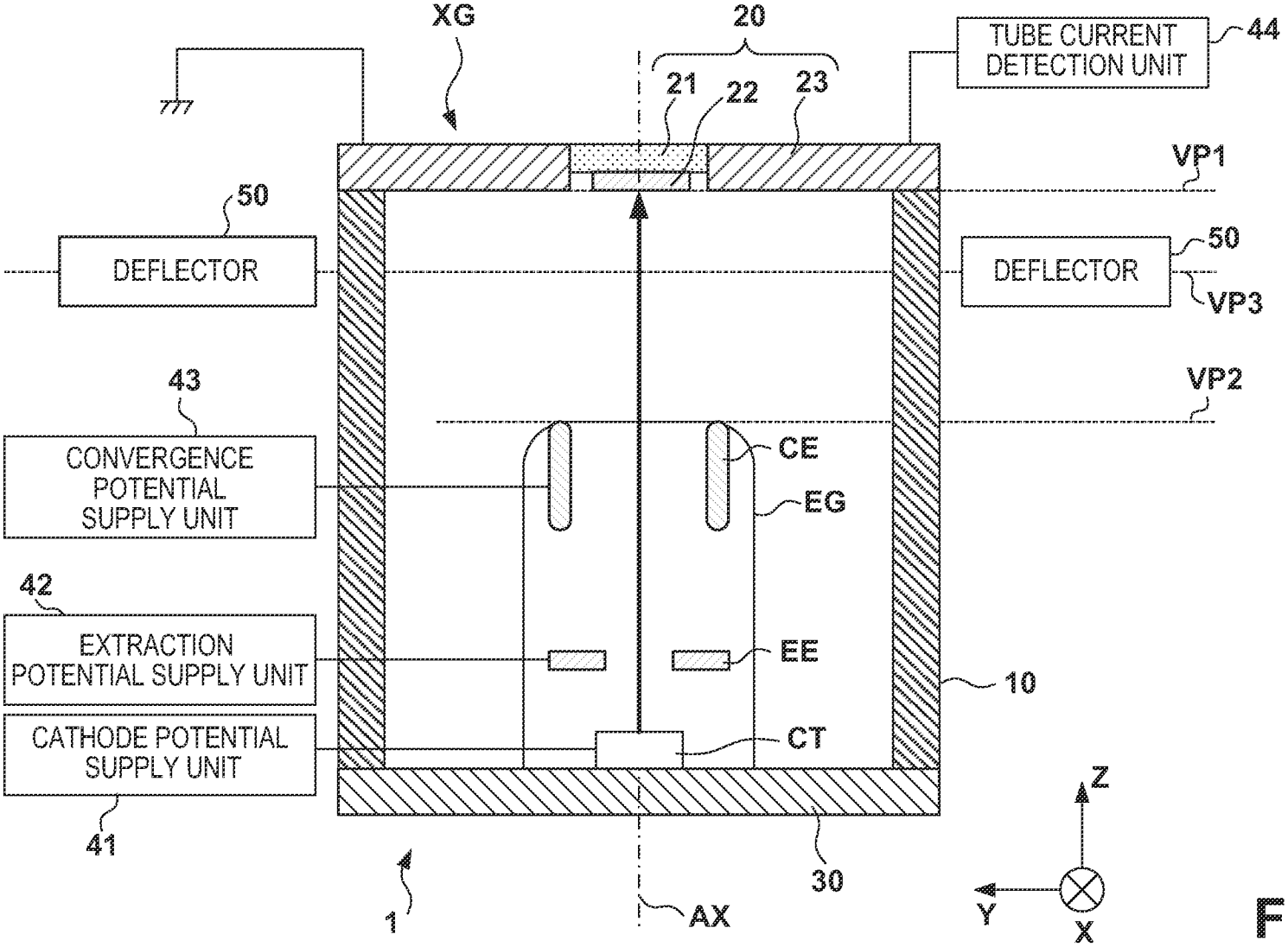
FIG. 1 is a view schematically showing the arrangement of an X-ray generating tube according to an embodiment.

Hereinafter, embodiments will be described in detail with reference to the accompanying drawings. It should be noted that the following embodiments are not intended to limit the scope of the appended claims. A plurality of features are described in the embodiments. However, not all the combinations of the plurality of features are necessarily essential to the present invention, and the plurality of features may arbitrarily be combined. In addition, the same reference numerals denote the same or similar parts in the accompanying drawings, and a repetitive description will be omitted.

FIG. 1 schematically shows a sectional arrangement of an X-ray generating tube XG near the center according to an embodiment. An X-ray generating apparatus 1 can be configured as a transmission type X-ray generating apparatus. The X-ray generating apparatus 1 includes an X-ray generating tube XG. The X-ray generating tube XG includes an electron gun EG. The X-ray generating tube XG can include a target 22 that receives the electron beam or electron emitted from the electron gun EG and generates X-rays. In an example, the X-ray generating tube XG can include an insulating tube 10 having two opening ends, an anode 20 that closes one of the two opening ends of the insulating tube 10, and a closing member 30 that closes the other of the two opening ends of the insulating tube 10. The anode 20 can include the target 22, a target holding plate 21 that holds the target 22, and an electrode 23 that applies a potential to the target 22 through the target holding plate 21 while supporting the target holding plate 21. The anode 20 can be maintained at, for example, the ground potential. The other closing member 30 can be configured to hold the electron gun EG. The insulating tube 10, the anode 20, and the closing member 30 can form a container that defines an enclosed space. The enclosed space can be maintained at a vacuum or a high degree of vacuum.

The electron gun EG can include a cathode CT, an extraction electrode EE that is arranged between the cathode CT and the anode 20, and a convergence electrode CE that is arranged between the extraction electrode EE and the anode 20. The cathode CT emits electrons. An accelerating voltage is supplied between the cathode CT and the anode 20. The amount of electrons entering the target 22 of the anode 20 per unit time, that is, a current, is called a tube current, which can depend on the extraction potential supplied to the extraction electrode EE. The convergence electrode CE converges the electrons or electron beam emitted from the cathode CT. The convergence electrode CE may include a plurality of electrodes.

The X-ray generating apparatus 1 can include a cathode potential supply source 41 that supplies a cathode potential to the cathode CT. The cathode potential supply source 41 may be understood as a constituent element that supplies an accelerating voltage between the cathode CT and the anode 20 that can be maintained at the ground potential. The X-ray generating apparatus 1 can include an extraction potential supply unit 42 that supplies an extraction potential to the extraction electrode EE. The extraction potential supply unit 42 may be understood as a constituent element that supplies an extraction potential between the cathode CT and the extraction electrode EE. The X-ray generating apparatus 1 can include a convergence potential supply unit 43 that supplies a convergence potential to the convergence electrode CE. The convergence potential supply unit 43 may be understood as a constituent element that supplies a convergence voltage between the cathode CT and the convergence electrode CE.

The X-ray generating apparatus 1 can further include a deflector 50 that deflects the electron beam emitted from the electron gun EG. The deflector 50 can be arranged outside the X-ray generating tube XG. For example, the deflector 50 can be arranged such that a virtual plane VP3 crossing the deflector 50 is positioned between a virtual plane VP1 including the electron beam incident surface (the surface facing the electron gun EG) of the target 22 and a virtual plane VP2 including the distal end face (the surface on the target 22 side) of the electron gun EG. The virtual planes VP1, VP2, and VP3 can be defined as planes vertically intersecting a central axis AX of the electron gun EG. The deflector 50 deflects the electron beam emitted from the electron gun EG by exerting an electric field on the electron beam. The amount of electron beam deflected by the deflector 50 can depend on the accelerating voltage.

The deflector 50 may be formed from a permanent magnet, an electromagnet, or a permanent magnet and an electromagnet. For example, the deflector 50 can include a first magnet and a second magnet. The first magnetic pole (for example, the S-pole) of the first magnet and the second magnetic pole (for example, the N-pole) of the second magnet can be arranged so as to face each other through the insulating tube 10 or the X-ray generating tube XG. The deflector 50 may be formed from one magnet arranged such that its magnetic pole faces in the radial direction of the insulating tube 10 or the X-ray generating tube XG.

The electrode 23 is electrically connected to the target 22 and supplies a potential to the target 22. When electrons from the electron gun EG collide with the target 22, X-rays are generated. The X-rays generated by the target 22 are transmitted through the target holding plate 21 and emitted outside the X-ray generating tube XG. The anode 20 can be maintained at, for example, the ground potential but may be maintained at another potential. The target 22 can be formed from a metal material. The target 22 is preferably formed from a material having a high melting point, for example, tungsten, tantalum, or molybdenum. These materials are advantageous in improving the generation efficiency of X-rays. The target holding plate 21 can be formed from, for example, a material that can easily transmit X-rays, such as beryllium or diamond. The X-ray generating apparatus 1 can further include a tube current detection unit 44 that detects the amount of electrons entering the target 22 of the anode 20 per unit time, that is, a tube current.

Figure 2:
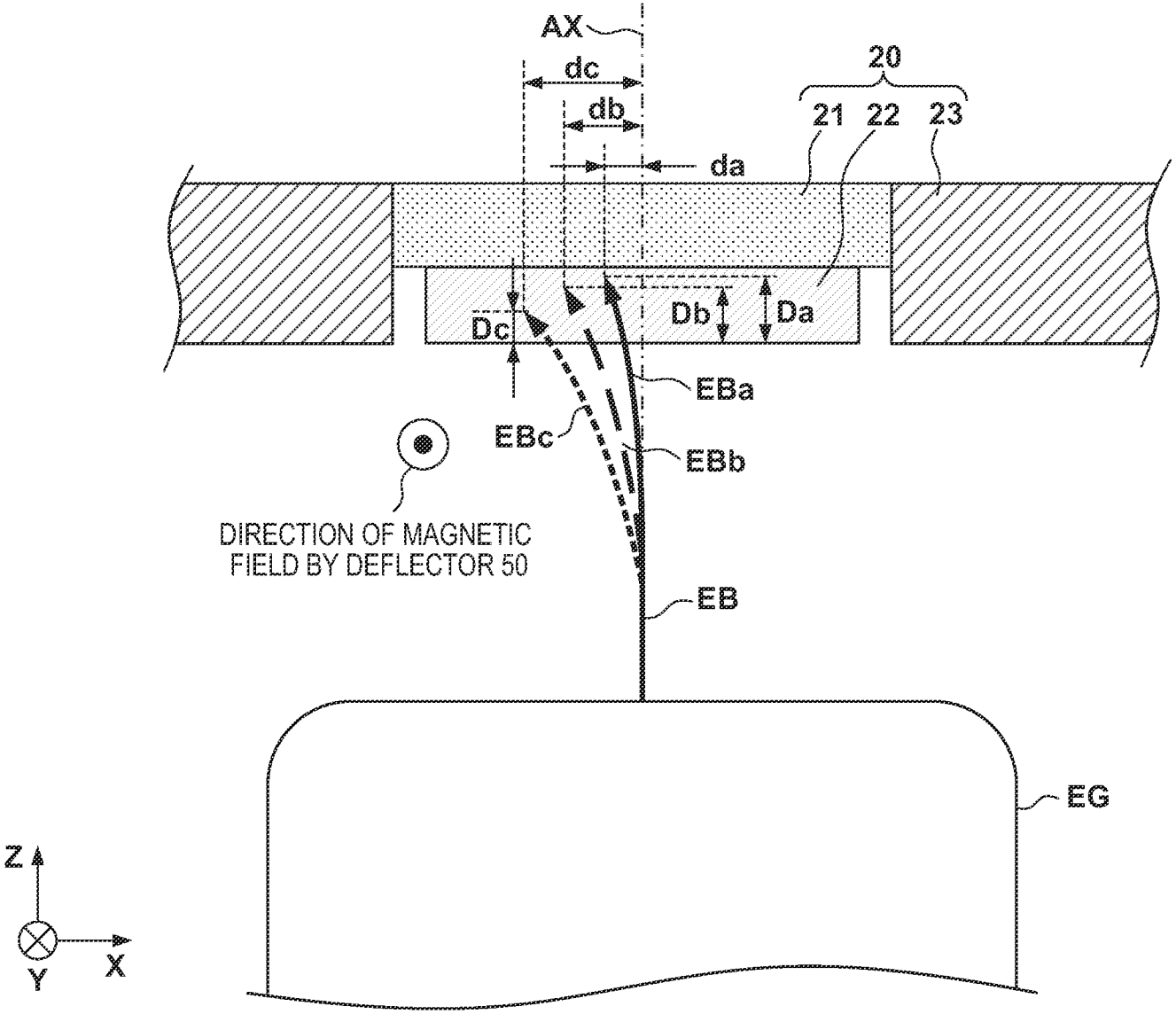
FIG. 2 is a view schematically showing how the electron beam emitted from an electron gun collides with a target.

FIG. 2 schematically shows how an electron beam EB emitted from the electron gun EG collides with the target 22. FIG. 2 shows the electron gun EG and the target 22 arranged close to each other. However, the electron gun EG and the target 22 can be arranged further separated from each other. The electron beam EB emitted from the electron gun EG enters or collides with the target 22 after being deflected by the magnetic field generated by the deflector 50. The amount by which the electron beam is deflected, in other words, the incident position of the electron beam with respect to the target 22, can depend on the magnetic field generated by the deflector 50 and the accelerating voltage.

Referring to FIG. 2, an electron beam EBa schematically indicates the path of the electron beam EB at an accelerating voltage Va (a voltage applied between the cathode CT and the anode 20). The electron beam EBa enters the target 22 to a depth Da determined by the accelerating voltage Va. An electron beam EBb schematically indicates the path of the electron beam EB at an accelerating voltage Vb. The electron beam EBb enters the target 22 to a depth Db determined by the accelerating voltage Vb. An electron beam EBc schematically indicates the path of the electron beam EB at an accelerating voltage Vc. The electron beam EBc enters the target 22 to a depth Dc determined by the accelerating voltage Vc. In this case, $|Va|>|Vb|>|Vc|$. Let da be the amount of deflection of the electron beam EBa (the shift amount of the incident position of the electron beam EB from the central axis AX), db be the amount of deflection of the electron beam EBb, and dc be the amount of deflection of the electron beam EBc. If the intensity of the magnetic field generated by the deflector 50 remains the same, $da<db<dc$.

Assume that the target 22 has an optimal thickness when it most efficiently emits X-rays at an applied accelerating voltage. In this case, if the thickness of the target 22 is larger than the optimal thickness, X-rays are attenuated until passage through the target 22. In contrast to this, if the thickness of the target 22 is smaller than the optimal thickness, the efficiency of conversion from an electron beam to X-rays in the target 22 decreases. Accordingly, the optimal thickness depends on the accelerating voltage. As described above, the deflection amount of an electron beam (the incident position of an electron beam with respect to the target 22) depends on the accelerating voltage. This means that it is possible to adjust the thickness of the target 22 for each deflection amount (that is, each incident position) corresponding to an accelerating voltage.

Figure 3:
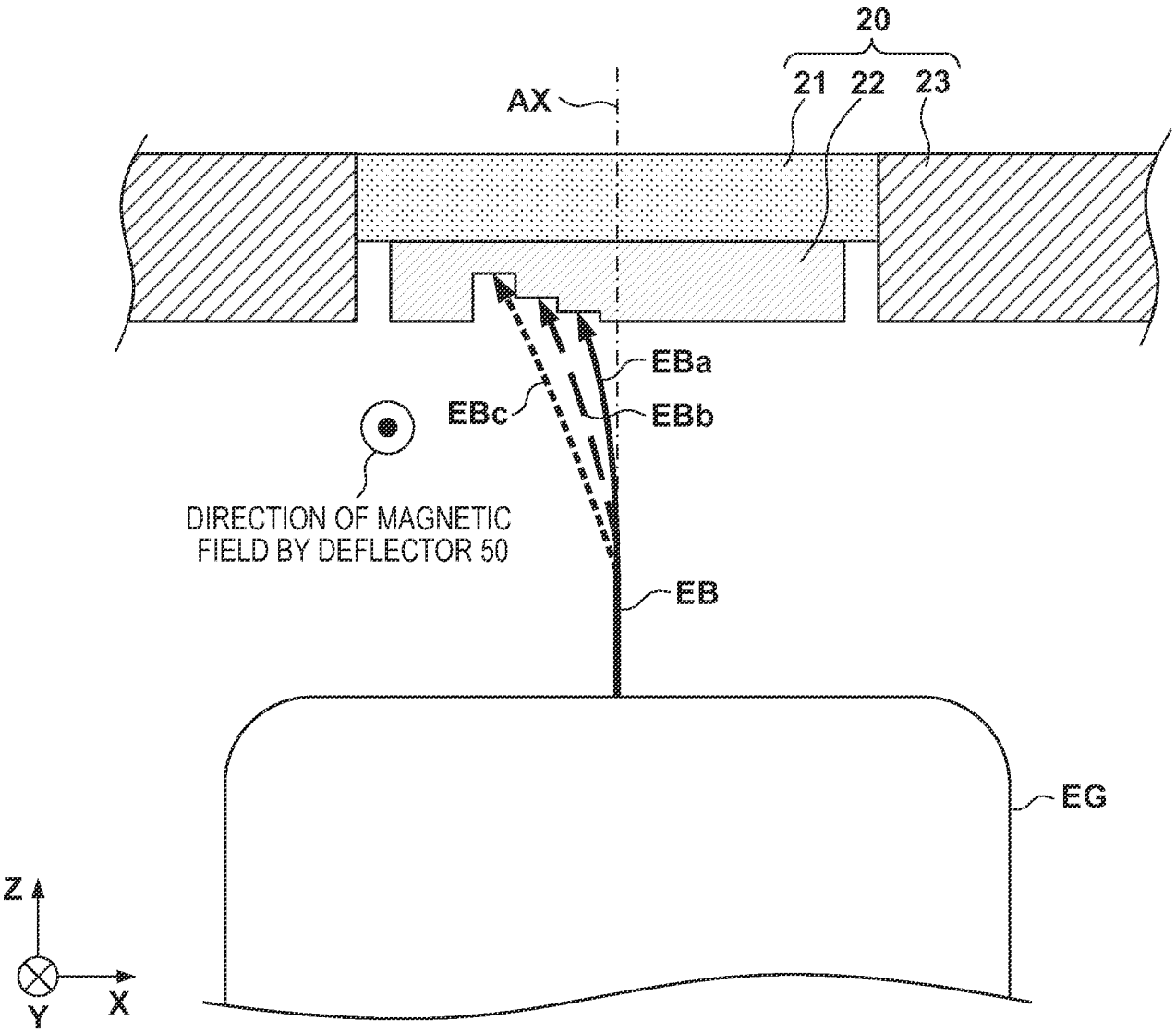
FIG. 3 is a view schematically showing the operation of thinning a target for each detection amount (that is, incident position) corresponding to an accelerating voltage.

FIG. 3 schematically shows the operation of thinning the target 22 for each deflection amount (that is, each incident position) corresponding to an accelerating voltage. As described above, the depth by which the electron beam EB enters the target 22 is determined by an accelerating voltage. On the other hand, Joule heat is generated at the incident position of the electron beam EB on the target 22, and the amount of Joule heat is determined by a tube current depending on the extraction potential supplied to the extraction electrode EE. As will be described in detail later, the X-ray generating apparatus 1 has a first mode for thinning the target 22 by irradiating the target 22 with an electron beam with a current adjusted within a first current range and a second mode of generating X-rays by irradiating the target 22 with an electron beam with a current adjusted within a second current range. The lower limit of the first current range is larger than the upper limit of the second current range. The lower limit of the first current range can be two, three, four, or five times larger than the upper limit of the second current range. The first mode may be understood as a processing mode for adjusting the thickness of the target 22. The second mode may be understood as an X-ray generating mode for generating X-rays.

In the first mode (processing mode), the target 22 is thinned or the thickness of the target 22 is adjusted by evaporating a portion of the target 22, which the electron beam EB enters, with the Joule heat generated by irradiating the target 22 with the electron beam EB. According to this embodiment, in the first mode, the thickness of the target 22 can be adjusted to the optimal thickness with a set tube voltage, and in the second mode (X-ray generating mode), the target 22 can be irradiated with the electron beam EB with the set tube voltage. This makes it possible to efficiently generate X-rays by irradiating the electron beam EB at the position where the thickness is adjusted to the optimal thickness. X-rays can be efficiently generated at each of a plurality of tube voltages by adjusting the thickness of the target 22 to an optimal thickness for each of a plurality of tube voltages, that is, each of a plurality of positions of the target 22.

FIG. 3 schematically shows an example of adjusting the thickness of the target 22 to an optimal thickness at each of the incident positions of the accelerating voltage Va for generating the electron beam EBa, the accelerating voltage Vb for generating the electron beam EBb, and the accelerating voltage Vc for generating the electron beam EBc.

Figure 4:
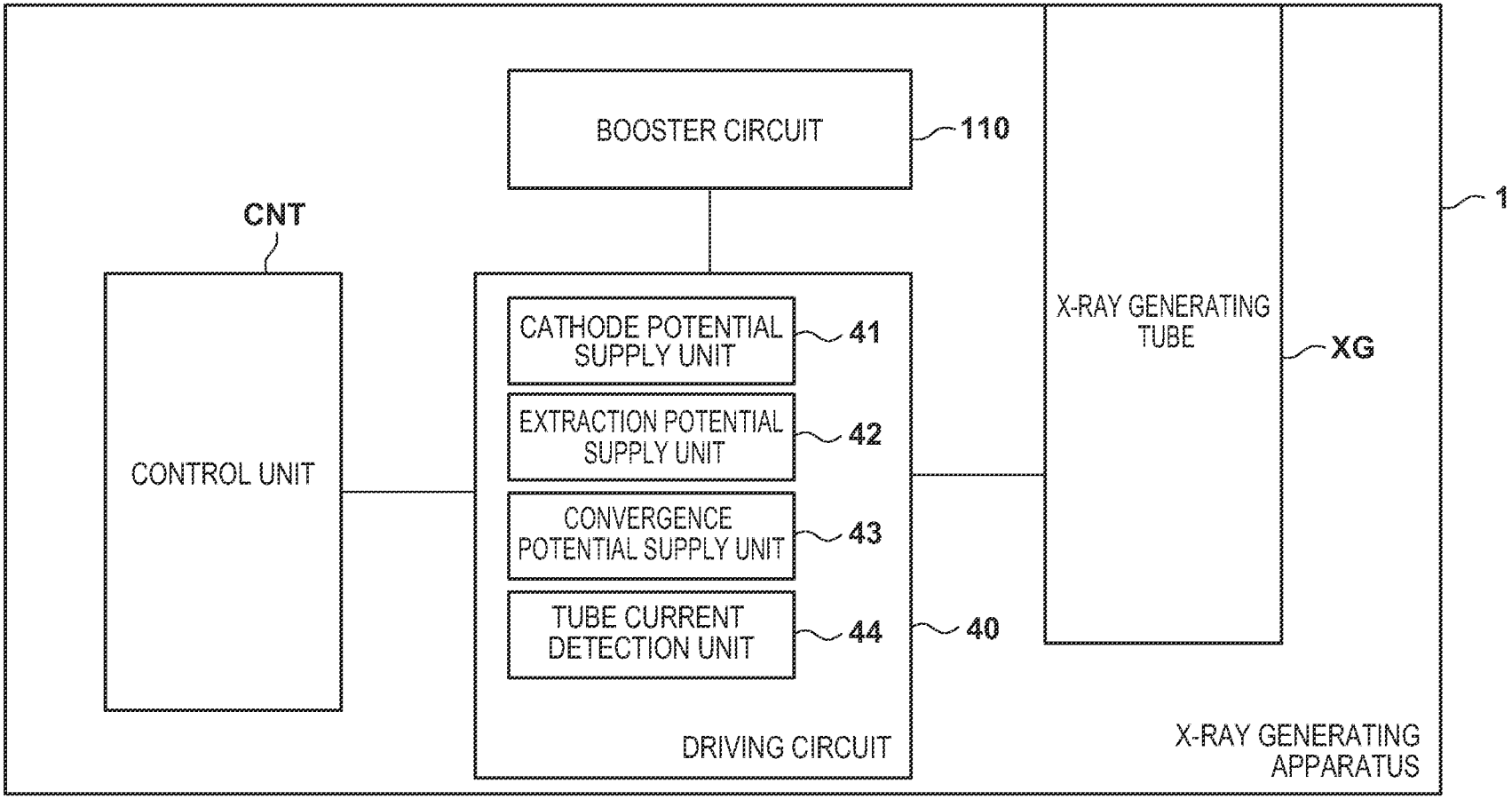
FIG. 4 is a block diagram exemplarily showing the arrangement of an X-ray generating apparatus according to an embodiment.

FIG. 4 is a block diagram exemplarily showing the arrangement of the X-ray generating apparatus 1 according to an embodiment. The X-ray generating apparatus 1 can include, for example, the X-ray generating tube XG, a booster circuit 110, a driving circuit 40, and a controller CNT. As described above, the X-ray generating tube XG can include the electron gun EG and the target 22 that generates X-rays by being irradiated with the electron beam EB emitted from the electron gun EG. The booster circuit 110 can boost an externally supplied voltage and supply the boosted voltage to the driving circuit 40. The booster circuit 110 may be understood as a part of the driving circuit 40.

The driving circuit 40 can include, for example, the cathode potential supply source 41, the extraction potential supply unit 42, the convergence potential supply unit 43, and the tube current detection unit 44. The controller CNT includes, for example, a CPU and a memory storing programs. The CPU can operate so as to control the driving circuit 40 by operating based on the programs. Alternatively, the controller CNT may be formed from, for example, a PLD (abbreviation for Programmable Logic Device) such as an FPGA (abbreviation for Field Programmable Gate Array) or an ASIC (abbreviation for Application Specific Integrated Circuit).

The controller CNT may be incorporated in the driving circuit 40. All or part of the controller CNT may be arranged inside or outside a housing (not shown) accommodating the booster circuit 110, the driving circuit 40, and the X-ray generating tube XG. The controller CNT can be configured to control the execution of the first mode for thinning the target 22 by irradiating the target 22 with the electron beam EB with a current adjusted within the first current range and the second mode for generating X-rays by irradiating the target 22 with the electron beam EB with a current adjusted within the second current range. If the execution of the first mode is unnecessary, a module for executing the first mode may be removed from the controller CNT.

Figure 5:
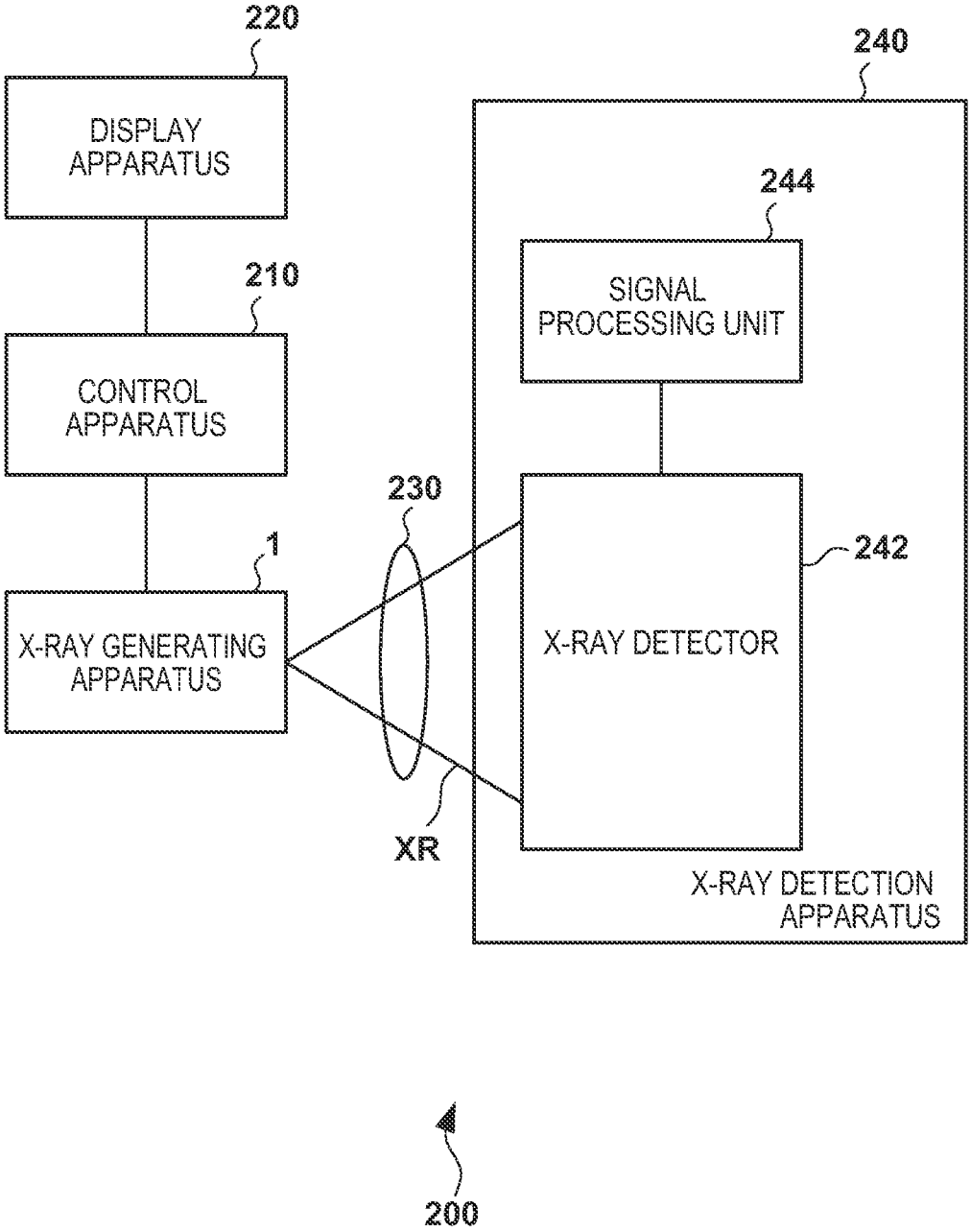
FIG. 5 is a block diagram schematically showing the arrangement of an X-ray imaging apparatus according to an embodiment.

FIG. 5 shows the arrangement of an X-ray imaging apparatus 200 according to an embodiment. The X-ray imaging apparatus 200 can include the X-ray generating apparatus 1 and an X-ray detection apparatus 240 that detects X-rays XR emitted from the X-ray generating apparatus 1 and transmitted through an object 230. The X-ray detection apparatus 240 may further include a control apparatus 210 and a display apparatus 220. The X-ray detection apparatus 240 can include an X-ray detector 242 and a signal processing unit 244. The control apparatus 210 can control the X-ray generating apparatus 1 and the X-ray detection apparatus 240. All or part of the controller CNT described above may be incorporated in the control apparatus 210. The X-ray detector 242 can detect or image the X-rays XR emitted from the X-ray generating apparatus 1 and transmitted through the object 230. The signal processing unit 244 can process a signal output from the X-ray detector 242 and supply the processed signal to the control apparatus 210. The control apparatus 210 causes the display apparatus 220 to display an image based on the signal supplied from the signal processing unit 244.

Figure 6:
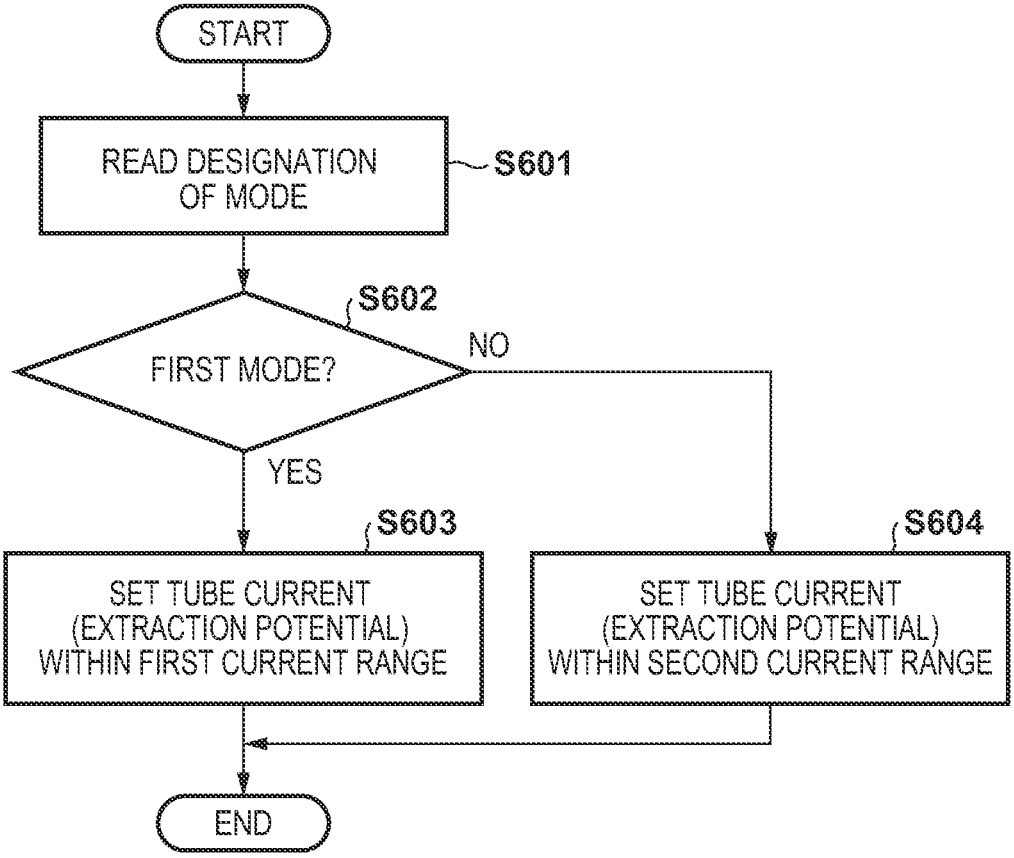
FIG. 6 is a flowchart showing an example of the operation of the X-ray generating apparatus concerning the execution of a first mode (processing mode) and a second mode (X-ray generating mode)

FIG. 6 shows an example of the operation of the X-ray generating apparatus 1 concerning the execution of the first mode (processing mode) and the second mode (X-ray generating mode). The controller CNT can control the operation shown in FIG. 6. In step S601, the controller CNT reads the designation of a mode. In step S602, the controller CNT determines whether the designation of the mode read in step S601 is the first mode or the second mode. If the first mode is designated, the controller CNT executes step S603. If the second mode is designated, the control unit CNT executes step S604. Note that the modes that the controller CNT can execute may include, in addition to the first and second modes, other modes such as the third mode.

In step S603, as a preparation for the execution of the first mode (processing mode), the controller CNT sets the extraction potential supply unit 42 so as to generate a first extraction potential for making a tube current within the first current range flow. In step S604, as a preparation for the execution of the second mode (X-ray generating mode), the controller CNT sets the extraction potential supply unit 42 so as to generate a second extraction potential for making a tube current within the second current range flow.

Figure 7:
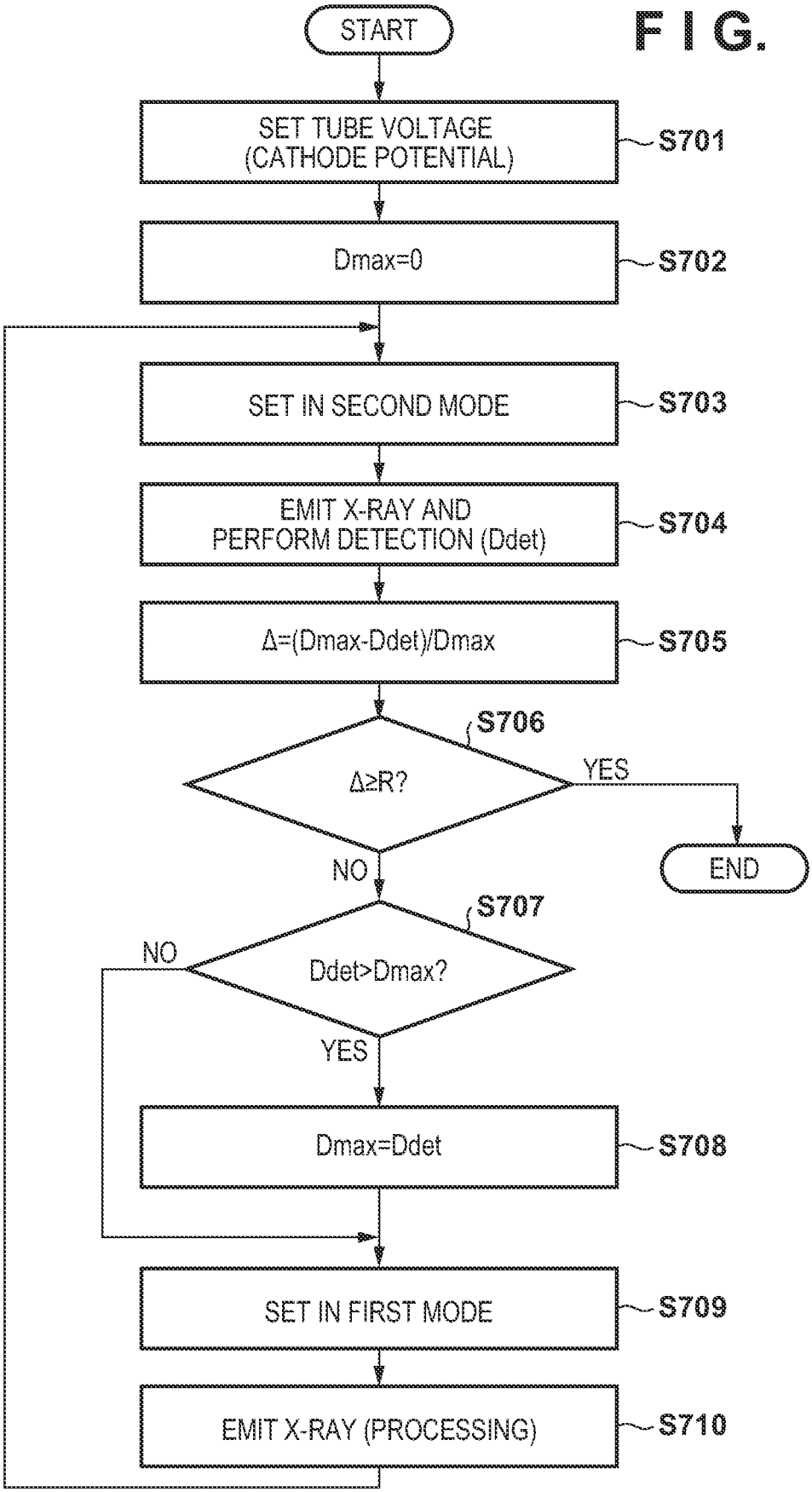
FIG. 7 is a flowchart showing an example of the operation of the X-ray generating apparatus concerning the adjustment of the thickness of a target with respect to one tube voltage (cathode potential)

FIG. 7 shows an example of the operation of the X-ray generating apparatus 1 concerning the adjustment of the thickness of the target 22 for one tube voltage (cathode potential). In adjusting the thickness of the target 22 for each of a plurality of tube voltages (cathode potentials), the operation shown in FIG. 7 can be executed for each tube voltage. The controller CNT can control the operation shown in FIG. 7. In step S701, the controller CNT sets the cathode potential supply source 41 so as to generate a target tube voltage. Steps S702 to S710 to be described below are executed while the tube voltage set in step S701 is maintained. In step S702, the controller CNT sets a parameter Dmax to be used in the following processing to 0 or a value near 0.

In step S703, the controller CNT starts the operation shown in FIG. 6 and sets the X-ray generating apparatus 1 or the extraction potential supply unit 42 in the second mode (X-ray generating mode). In step S704, the controller CNT causes the cathode CT to emit the electron beam EB to cause the target 22 to emit X-rays. The controller CNT then causes the X-ray detector, arranged to detect the X-rays, to detect the X-rays, thereby taking in the detection result as Ddet. This X-ray detector can be installed at a position where it can detect X-rays generated by the X-ray generating apparatus 1 and can be communicably connected to the controller CNT before the execution of the operation in FIG. 7. As this X-ray detector, an X-ray detector like the X-ray detector 242 of the X-ray imaging apparatus 200 shown in FIG. 5 may be used. Step S703 can be understood as a step of checking the dose of X-rays emitted from the target 22 at the current tube voltage (in other words, the incident position of the electron beam EB with respect to the target 22) and the thickness of the target 22 at the incident position.

In step S705, the controller CNT calculates a change rate Δ of Ddet from Dmax. A calculation formula for calculating the change rate Δ can be provided by, for example, $\Delta=(Dmax-Ddet)/Dmax$. In this case, that the value of the change rate Δ is positive indicates that a change in the dose of X-rays due to processing (thinning) of the target 22 in the first mode (processing mode) has exceeded its peak. In contrast to this, that the value of the change rate Δ is negative indicates that a change in the dose of X-rays due to processing (thinning) of the target 22 in the first mode (processing mode) has not exceeded its peak.

In step S706, the controller CNT determines whether the value of the change rate Δ becomes equal to or more than a determination reference value R, in other words, whether thinning is completed. If the value of the change rate Δ becomes equal to or more than the determination reference value R, the operation shown in FIG. 7 is completed; otherwise, step S707 is executed. In this case, that the determination reference value R is a positive value, and the value of the change rate Δ becomes equal to or more than the determination reference value R means that it is confirmed that a change in the dose of X-rays due to processing (thinning) of the target 22 in the first mode (processing mode) has exceeded its peak, in other words, the peak of the dose of X-rays is detected. The value of the determination reference value R may be arbitrarily set in consideration of noise, a detection error, and the like and can be set to, for example, 0.01. That the determination reference value R is 0.01 means that the dose of X-rays detected has decreased from the peak value by 1%. In this case, although the target 22 is thinned until the above calculation formula and the determination reference value are satisfied, thinning of the target 22 may be executed until other predetermined conditions are satisfied. The other predetermined conditions include, for example, that the thickness of the target 22 at the incident position of an electron beam falls within the allowable range of target film thicknesses.

In step S707, the controller CNT determines whether Ddet is larger than Dmax. If Ddet is larger than Dmax, the value of Dmax is replaced with the value of Ddet in step S708 (that is, Dmax is updated).

In step S709, the controller CNT starts the operation shown in FIG. 6 and sets the X-ray generating apparatus 1 or the extraction potential supply unit 42 in the first mode (processing mode). In step S710, the controller CNT thins the target 22 (at the incident position determined by a tube voltage to the target 22) by irradiating the target 22 with the electron beam EB with a current adjusted within the first current range for processing (thinning) the target 22. Step S710 is executed over a preset time, and steps S701 to S710 are repeated afterward.

Figure 8:
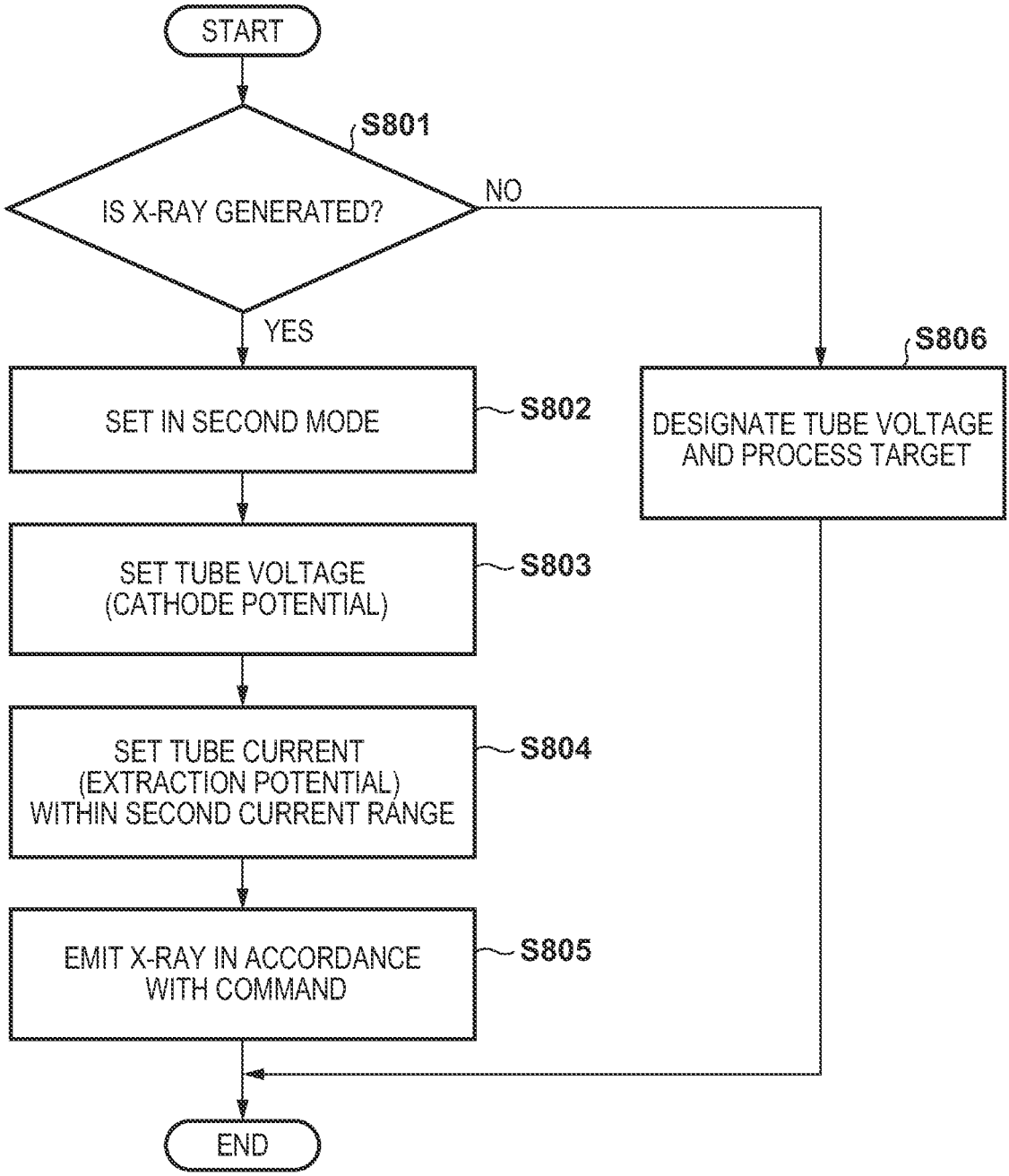
FIG. 8 is a flowchart showing an example of the operation of the X-ray generating apparatus or an example of using the apparatus.

FIG. 8 shows an example of the operation of the X-ray generating apparatus 1 or an example of using the X-ray generating apparatus 1. The controller CNT can control the operation shown in FIG. 8. In step S801, the controller CNT determines whether the X-ray generating apparatus 1 is used for a normal operation, typically for X-ray imaging. If the X-ray generating apparatus 1 is used for a normal operation, steps S802 to S805 are executed. In contrast to this, if the thickness of the target 22 is to be adjusted, the operation shown in FIG. 7 is executed in step S806.

In step S802, the controller CNT starts the operation shown in FIG. 6 and sets the X-ray generating apparatus 1 or the extraction potential supply unit 42 in the second mode (X-ray generating mode). In step S803, the controller CNT sets the cathode potential supply source 41 so as to generate a target tube voltage. In step S804, as a preparation for the execution of the second mode (X-ray generating mode), the controller CNT sets the extraction potential supply unit 42 so as to generate the second extraction potential for making a tube current within the second current range flow. In step S805, the controller CNT controls the cathode potential supply source 41 so as to cause the cathode CT to emit an electron beam in accordance with a command from a host control apparatus, for example, the control apparatus 210, thereby causing the target 22 which the electron beam enters to emit X-rays.

Figure 9:
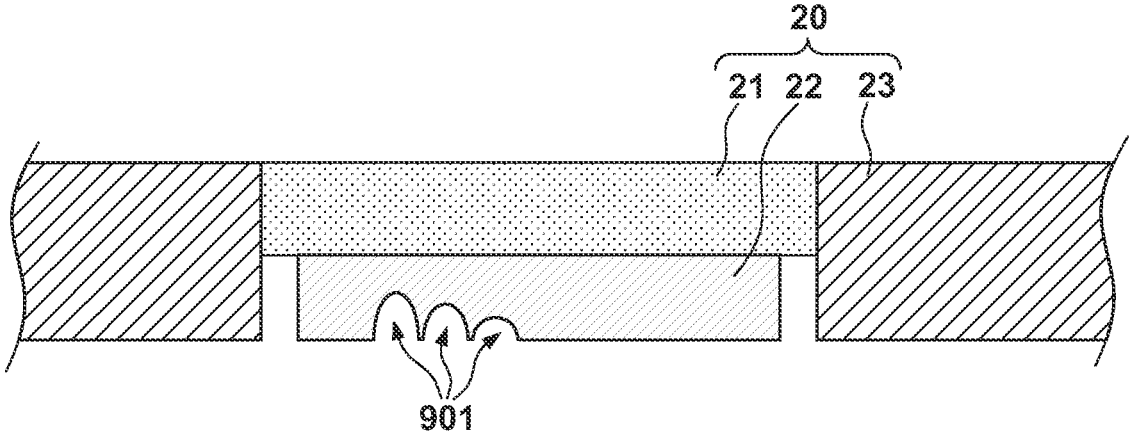
FIG. 9 is a view schematically showing part of an example of the arrangement of the X-ray generating apparatus having the target processed in the processing mode.
Figure 10:
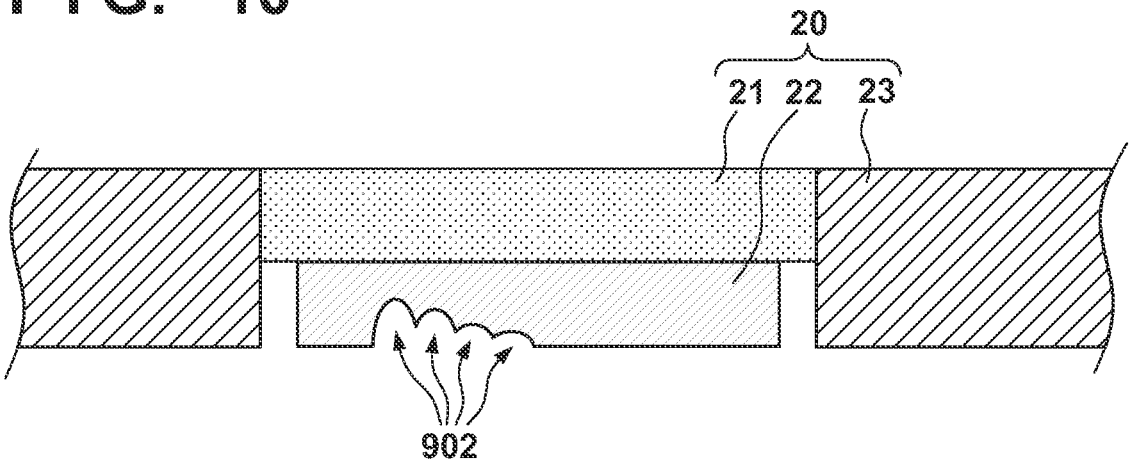
FIG. 10 is a view schematically showing part of an example of the arrangement of the X-ray generating apparatus having the target processed in the processing mode.
Figure 11:
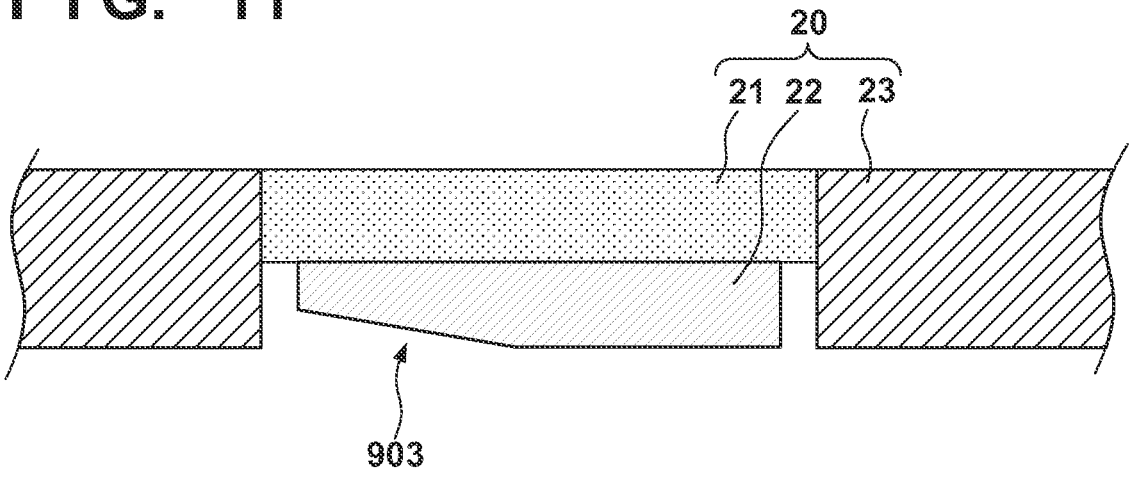
FIG. 11 is a view schematically showing part of an example of the arrangement of the X-ray generating apparatus having the target processed in the processing mode.

FIGS. 9, 10, and 11 each show part of the arrangement of the X-ray generating apparatus 1 having the target 22 processed by the above method. In the example in FIG. 9, the target 22 has a plurality of concave portions 901. The plurality of concave portions 901 are arranged at positions respectively corresponding to a plurality of accelerating voltages to be applied between the cathode CT of the electron gun EG and the target 22, and the target 22 has each of different thicknesses at the plurality of concave portions 901. In the example in FIG. 9, the plurality of concave portions 901 are arranged so as to be separated from each other.

In the example in FIG. 10 as well, the target 22 has a plurality of concave portions 902. The plurality of concave portions 902 are arranged at positions respectively corresponding to a plurality of accelerating voltages to be applied between the cathode CT of the electron gun EG and the target 22, and the target 22 has thicknesses different from each other at the plurality of concave portions 901. In the example in FIG. 10, the adjacent concave portions 902 of the plurality of concave portions 902 are arranged so as to be partially coupled to each other at their peripheries.

In the example in FIG. 11, the target 22 has an inclined surface 903 so as to have thicknesses adjusted at positions respectively corresponding to a plurality of accelerating voltages.

In this embodiment, in the first and second modes, if the accelerating voltage remains the same, an electron beam enters at the same position on the target and hence can be entered at the optimal position on the target 22 (the position where the target 22 has a thickness adjusted in the first mode). Accordingly, in the embodiment, there is no need to have an arrangement or perform an operation for the adjustment of the incident position of an electron beam with respect to a target in accordance with an accelerating voltage.

The present invention is not limited to the above embodiments and various changes and modifications can be made within the spirit and scope of the present invention. Therefore, to apprise the public of the scope of the present invention, the following claims are made.

The invention claimed is:

1. An X-ray generating apparatus including an electron gun and a target configured to generate X-rays by being irradiated with an electron beam emitted from the electron gun, the apparatus comprising:

a controller configured to control a first mode for thinning the target by irradiating the target with an electron beam with a current adjusted within a first current range and a second mode for generating X-rays by irradiating the target with an electron beam with a current adjusted within a second current range, wherein the first current range has a lower limit larger than an upper limit of the second current range.

2. The X-ray generating apparatus according to claim 1, further comprising a deflector configured to deflect the electron beam, wherein an incident position of the electron beam with respect to the target changes depending on an accelerating voltage applied between a cathode of the electron gun and the target, and the controller thins the target for each of a plurality of incident positions respectively corresponding to a plurality of accelerating voltages in the first mode.

3. The X-ray generating apparatus according to claim 2, wherein the controller determines end of thinning of the target in the first mode based on a dose of X-rays emitted from the target.

4. The X-ray generating apparatus according to claim 3, wherein the controller determines end of thinning of the target in the first mode based on a dose of X-rays emitted from the target in the second mode.

5. The X-ray generating apparatus according to claim 4, wherein the target is thinned by evaporating part of the target on which the electron beam enters in the first mode, and the controller thins the target until a predetermined condition is satisfied while repeating thinning of the target in the first mode and detection of a dose of X-rays emitted from the target in the second mode while the accelerating voltage is maintained at an accelerating voltage with which the target is to be thinned.

6. The X-ray generating apparatus according to claim 5, wherein the predetermined condition is that a peak of a dose of X-rays emitted from the target is detected.

7. The X-ray generating apparatus according to claim 1, wherein the first current range has a lower limit not less than twice an upper limit of the second current range.

8. The X-ray generating apparatus according to claim 1, wherein the electron gun includes a cathode, an anode including the target, an extraction electrode arranged between the cathode and the anode, and a convergence electrode arranged between the extraction electrode and the anode, and the controller sets a potential of the extraction electrode to a first potential in the first mode and sets a potential of the extraction electrode to a second potential different from the first potential in the second mode.

9. An adjustment method of adjusting a thickness of a target in an X-ray generating apparatus including an electron gun and the target configured to generate X-rays by being irradiated with an electron beam emitted from the electron gun, the adjustment method comprising:

a thinning step of thinning the target by irradiating the target with an electron beam with a current adjusted within a first current range; and a detecting step of detecting X-rays generated by irradiating the target with an electron beam with a current adjusted within a second current range, wherein the first current range has a lower limit larger than an upper limit of the second current range.

10. The adjustment method according to claim 9, wherein the thinning step and the detecting step are repeated until a dose of X-rays emitted from the target satisfies a predetermined condition in the detecting step.

11. The adjustment method according to claim 10, wherein the predetermined condition is that a peak of a dose of X-rays emitted from the target is detected.

12. The adjustment method according to claim 9, wherein the X-ray generating apparatus further comprises a deflector configured to deflect the electron beam, an incident position of the electron beam with respect to the target changes depending on an accelerating voltage applied between a cathode of the electron gun and the target, and the thinning step and the detecting step are executed for each of a plurality of incident positions respectively corresponding to a plurality of accelerating voltages.

13. The adjustment method according to claim 9, wherein the first current range has a lower limit not less than twice an upper limit of the second current range.

14. The adjustment method according to claim 9, wherein the electron gun includes a cathode, an anode including the target, an extraction electrode arranged between the cathode and the anode, and a convergence electrode arranged between the extraction electrode and the anode, and in the thinning step, a potential of the extraction electrode is set to a first potential, and in the detecting step, a potential of the extraction electrode is set to a second potential different from the first potential.

15. A method of using an X-ray generating apparatus including an electron gun and a target configured to generate X-rays by being irradiated with an electron beam emitted from the electron gun, the method comprising:

a thinning step of thinning the target by irradiating the target with an electron beam with a current adjusted within a first current range; and a generating step of generating X-rays by irradiating the target with an electron beam with a current adjusted within a second current range, wherein the first current range has a lower limit larger than an upper limit of the second current range.

* * * * *